US010618781B2

(12) United States Patent
Miyazaki

(10) Patent No.: US 10,618,781 B2
(45) Date of Patent: Apr. 14, 2020

(54) CRAWLER CRANE CAR BODY WEIGHT SUPPORTING DEVICE

(71) Applicant: KOBELCO CONSTRUCTION MACHINERY CO., LTD., Hiroshima-shi (JP)

(72) Inventor: Kazuyuki Miyazaki, Hyogo (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 295 days.

(21) Appl. No.: 15/545,753

(22) PCT Filed: Feb. 8, 2016

(86) PCT No.: PCT/JP2016/000639
§ 371 (c)(1),
(2) Date: Jul. 24, 2017

(87) PCT Pub. No.: WO2016/129262
PCT Pub. Date: Aug. 18, 2016

(65) Prior Publication Data

US 2018/0022585 A1 Jan. 25, 2018

(30) Foreign Application Priority Data

Feb. 10, 2015 (JP) ..... 2015-024349

(51) Int. Cl.
*B66C 23/76* (2006.01)
*B66C 23/80* (2006.01)

(52) U.S. Cl.
CPC ..... *B66C 23/76* (2013.01); *B66C 23/80* (2013.01)

(58) Field of Classification Search
CPC ..... B66C 23/72; B66C 23/74; B66C 23/76; B66C 23/80
See application file for complete search history.

(56) References Cited

U.S. PATENT DOCUMENTS 3,842,984 A * 10/1974 Brown ..... B60G 3/00 212/195
3,945,518 A * 3/1976 Inoue ..... B66C 23/76 414/719
7,896,178 B2 * 3/2011 Davis ..... B66C 23/36 212/178

(Continued)

FOREIGN PATENT DOCUMENTS

CN 101804946 A 8/2010
CN 102020210 A 4/2011

(Continued)

OTHER PUBLICATIONS

International Search Report dated Apr. 19, 2016, in PCT/JP2016/000639, filed Feb. 8, 2016.

(Continued)

*Primary Examiner* — Michael E Gallion
(74) *Attorney, Agent, or Firm* — Oblon, McClelland, Maier & Neustadt, L.L.P.

(57) ABSTRACT

In a car body, a lower travelling body of a crawler crane includes a pair of left and right crawler frames, the car body connecting the crawler frames and supporting an upper slewing body, and a pair of car body weights are disposed on front and rear sides of the car body. The car body supporting device includes a supporting mechanism for movably supporting at least one of the paired car body weights, and a drive section for moving the car body weight supported by the supporting mechanism to thereby shift a center of gravity of the lower travelling body in a front and rear direction. The car body weight supporting device can improve postural stability.

6 Claims, 11 Drawing Sheets

(56) References Cited

U.S. PATENT DOCUMENTS

| | | | | |
|---|---|---|---|---|
| 7,967,158 | B2 * | 6/2011 | Pech | B66C 23/76 212/296 |
| 2006/0043042 | A1 * | 3/2006 | Kimura | B66C 23/74 212/178 |
| 2011/0031202 | A1 | 2/2011 | Pech et al. | |
| 2011/0031728 | A1 * | 2/2011 | Arzberger | B66C 23/74 280/755 |
| 2011/0155681 | A1 * | 6/2011 | Hanahara | B66C 23/74 212/196 |
| 2011/0192815 | A1 * | 8/2011 | Kurotsu | B66C 23/76 212/196 |
| 2013/0098860 | A1 | 4/2013 | Pech et al. | |
| 2013/0112642 | A1 | 5/2013 | Pech et al. | |
| 2016/0169413 | A1 * | 6/2016 | Camacho | F16L 1/06 701/50 |

FOREIGN PATENT DOCUMENTS

| | | | |
|---|---|---|---|
| CN | 102167262 | A | 8/2011 |
| JP | 53-48368 | U | 4/1978 |
| JP | 2003-56009 | A | 2/2003 |
| JP | 2003-171088 | A | 6/2003 |
| JP | 2006-219241 | A | 8/2006 |
| JP | 2011-37634 | A | 2/2011 |
| JP | 2013-144869 | A | 7/2013 |

OTHER PUBLICATIONS

Combined Chinese Office Action and Search Report dated Aug. 31, 2018 in Chinese Patent Application No. 201680009766.3 (with English translation and English translation of Category of Cited Documents), 15 pages.

* cited by examiner

CRAWLER CRANE CAR BODY WEIGHT SUPPORTING DEVICE

TECHNICAL FIELD

The present invention relates to a car body weight supporting device to be mounted on a lower travelling body of a crawler crane.

BACKGROUND ART

Conventional crawler cranes, such as one disclosed in Document 1 (Japanese Unexamined Patent Publication No. 2006-219241), include: a lower travelling body; an upper slewing body slewably mounted on the lower travelling body via a slewing bearing; an attachment such as boom, jib or the like for lifting a suspended load, the attachment having a proximal end supported on a front portion of the upper slewing body; and a counter weight disposed on a rear portion of the upper slewing body for increasing the lifting capacity. The lower travelling body includes a pair of left and right crawler frames (also referred to as "side frames") each having an outer periphery on which a crawler is mounted, and a car body (also referred to as "truck frame") connecting the crawler frames and supporting the upper slewing body.

Such a crawler crane sometimes includes a pair of car body weights (also referred to as "lower weights") disposed on front and rear sides of the car body of the lower travelling body in order to bring a center of gravity of the entire crawler crane into proximity to a machine center of the crawler crane, as described in the above-mentioned Document 1.

SUMMARY OF INVENTION

The present invention aims to provide a car body weight supporting device for a crawler crane capable of shifting a center of gravity of a lower travelling body according to the state of assembly or the like of the crawler crane to thereby improve postural stability.

In order to achieve the above-mentioned object, a crawler crane to which the present invention is applied includes: a lower travelling body; an upper slewing body slewably mounted on the lower travelling body; an attachment having a proximal end supported on a front portion of the upper slewing body in a raisable and lowerable manner; and a counter weight disposed on a rear portion of the upper slewing body, the lower travelling body having a pair of left and right crawler frames each carrying a crawler, a car body connecting the crawler frames and supporting the upper slewing body, and a pair of car body weights disposed on front and rear sides of the car body. A car body weight supporting device for the crawler crane according to the present invention includes: a supporting mechanism for movably supporting at least one of the paired car body weights; and a drive section for moving the car body weight supported by the supporting mechanism to thereby shift a center of gravity of the lower travelling body in a front and rear direction.

DESCRIPTION OF EMBODIMENTS

A crawler crane according to embodiments of the present invention includes a pair of car body weights disposed on front and rear sides of a car body of a lower travelling body. Conventionally, the paired car body weights are respectively securely attached to specific positions on the front and rear sides of the car body in such a way as to allow a center of gravity of the lower travelling body to coincide with a pivotal center of an upper slewing body, the specific positions lying on both sides of the pivotal center. However, it is sometimes desirable to shift the center of gravity of the lower travelling body according to the state of assembly, the work, or the like of the crawler crane. Specifically, when a long attachment is raised off the ground by a driving force of the crawler came, it is desirable to shift the center of gravity of the lower travelling body in a direction away from the pivotal center of the upper slewing body and closer to a counter weight (i.e. closer to a rear portion) to secure the postural stability of the crane while preventing its forward overturning. On the other hand, when the crane is in the middle of being assembled and not yet mounted with an attachment, it is desirable to shift the center of gravity of the lower travelling body in a direction closer to an attachment (i.e. closer to a front portion) in order to secure the postural stability of the crane while preventing its rearward overturning. The present invention makes it possible to shift the center of gravity of the lower travelling body according to the state of assembly or the like of the crawler crane. Hereinafter, the embodiments of the present invention will be described with reference to the accompanying drawings.

Figure 1:
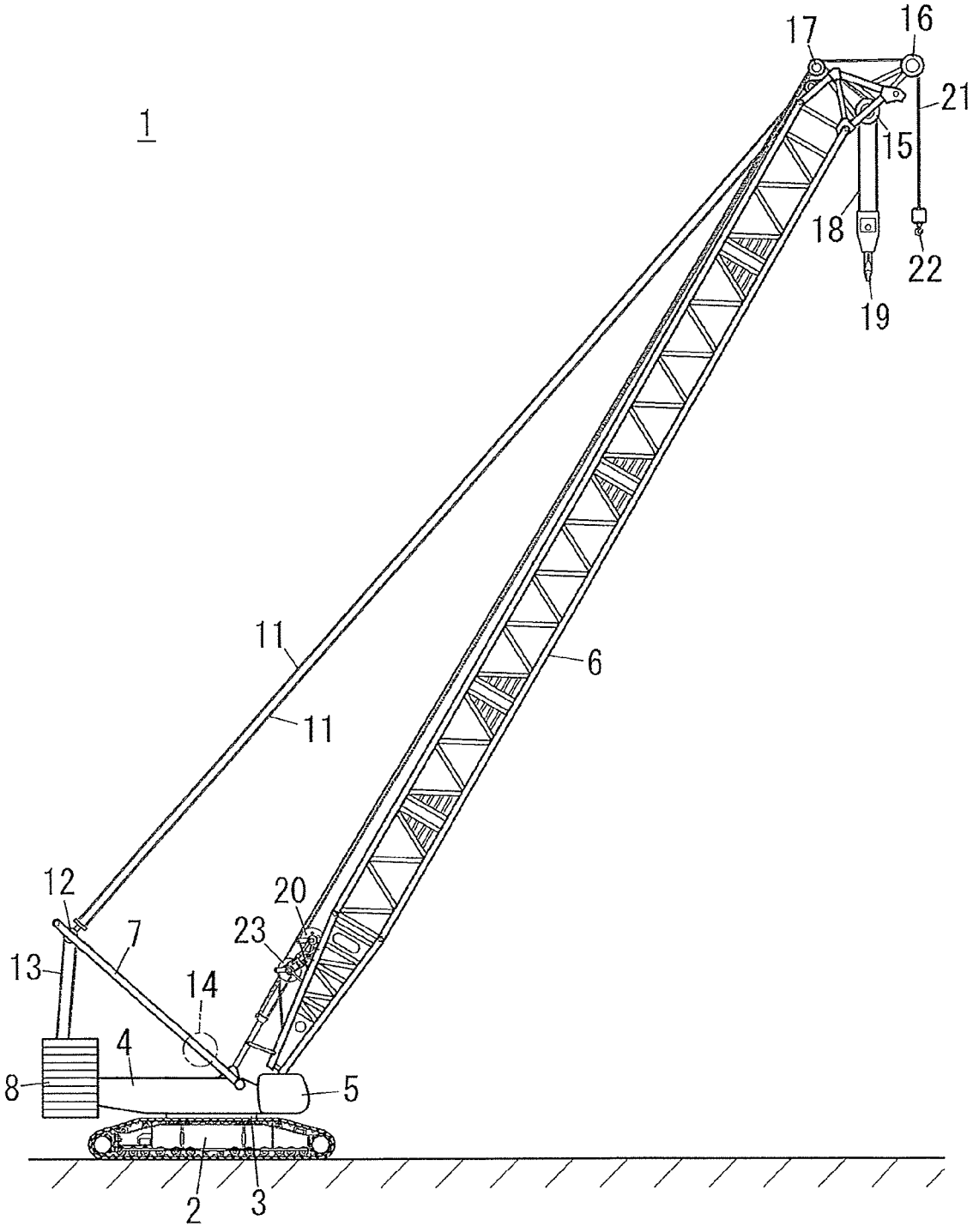
FIG. 1 is a side view showing a crawler crane according to a first embodiment of the present invention, the crawler crane being in a working state.
Figure 2:
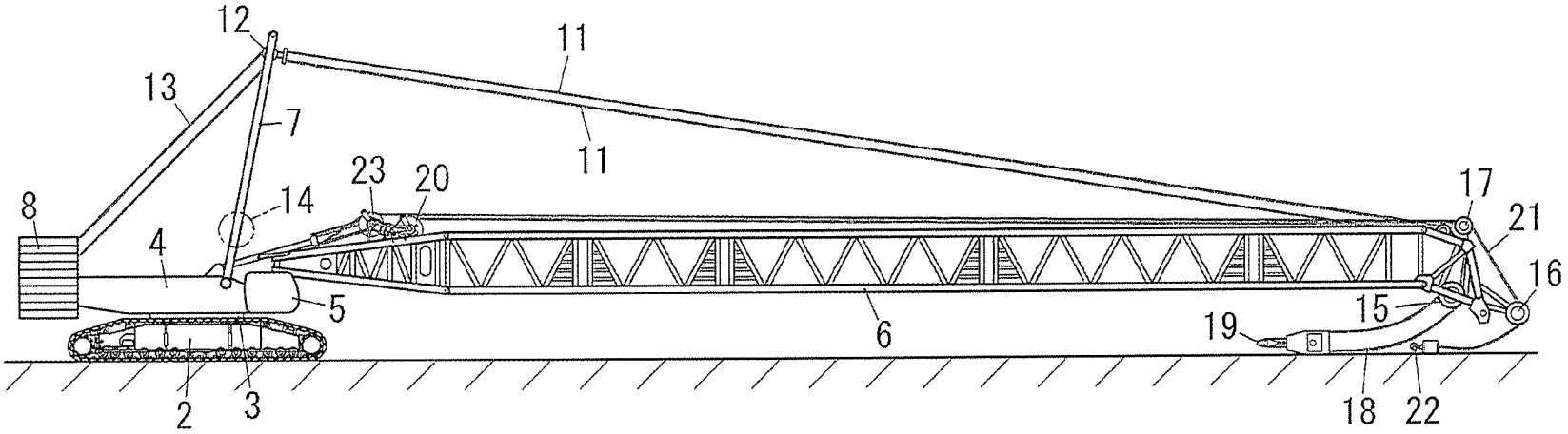
FIG. 2 is a side view showing the crawler crane in an assembled state.

FIGS. 1 and 2 show an overall configuration of a crawler crane 1 according to a first embodiment of the present invention. The crawler crane 1 includes a lower travelling body 2, and an upper slewing body 4 slewably mounted on the lower travelling body 2 via a slewing bearing 3.

The upper slewing body 4 has a longer dimension, and a cab 5 for housing a driver is disposed at a first end of the upper slewing body 4 in a longitudinal direction, the first end defining a front portion of the upper slewing body 4. In addition, a proximal end of a boom 6 and a proximal end of a mast 7 are supported on the front portion of the upper slewing body 4 in such a way as to be pivotable within a respective predetermined angle range, the boom 6 and the mast 7 being provided as attachments. On the other hand, a counter weight 8 is disposed at a second end of the upper slewing body 4 in the longitudinal direction, the second end defining a rear portion of the upper slewing body 4.

A distal end of the boom 6 and a distal end of the mast 7 are connected to each other via boom guy lines 11. An upper spreader 12 is disposed on the distal end of the mast 7, and a boom hoisting rope 13 is wound around the upper spreader 12 and a lower spreader (not shown) disposed on the rear portion of the upper slewing body 4, one end of the hoisting rope 13 being wound on a boom hoisting winch 14 disposed on the proximal end of the mast 7 or the upper slewing body 4. The boom hoisting rope 13 is pulled in by the boom hoisting winch 14 to shorten the distance between the upper spreader 12 and the lower spreader (i.e. the rear portion of the upper slewing body 4) to thereby pivot the boom 6 in a rising direction. On the other hand, the boom hoisting rope 13 is paid out by the boom hoisting winch 14 to extend the distance between the upper spreader 12 and the lower spreader to thereby pivot the boom 6 forward in a lowering direction.

At the distal end of the boom 6, there are disposed a boom point sheave 15, an auxiliary sheave 16, and an idler sheave 17. A main hook 19 is hung from the boom point sheave 15 by a main winding rope 18. One end of the main winding rope 18 is wound on a main winding winch 20 disposed on the proximal end of the boom 6 through an idler sheave 17. The main winding rope 18 is pulled in or paid out by the main winding winch 20 to raise or lower the main hook 19.

Further, an auxiliary hook 22 is hung from the auxiliary sheave 16 by an auxiliary winding rope 21, and one end of the auxiliary rope 21 is wound on an auxiliary winding winch 23 disposed on the proximal end of the boom 6 through the idler sheave 17. The auxiliary winding rope 21 is pulled in or paid out by the auxiliary winding winch 23 to raise or lower the auxiliary hook 22.

Figure 3:
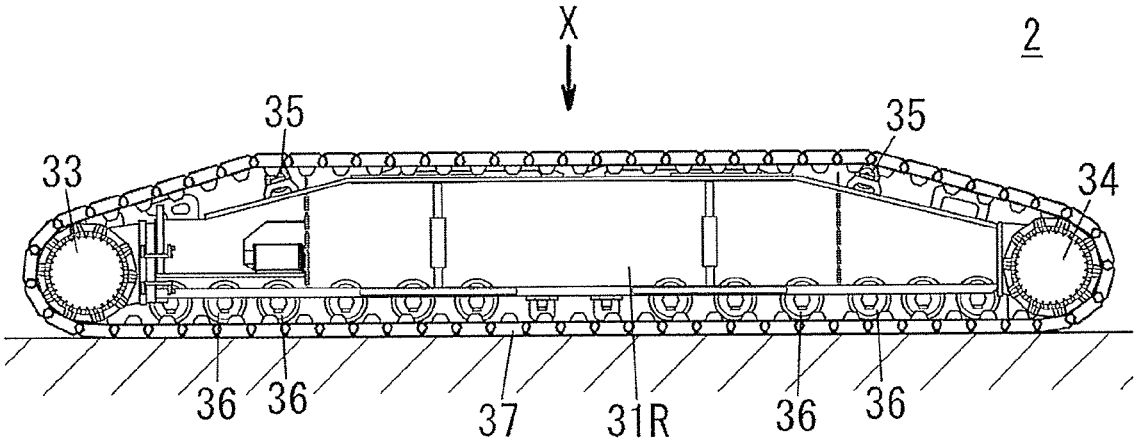
FIG. 3 is a side view of a lower travelling body of the crawler crane.
Figure 4:
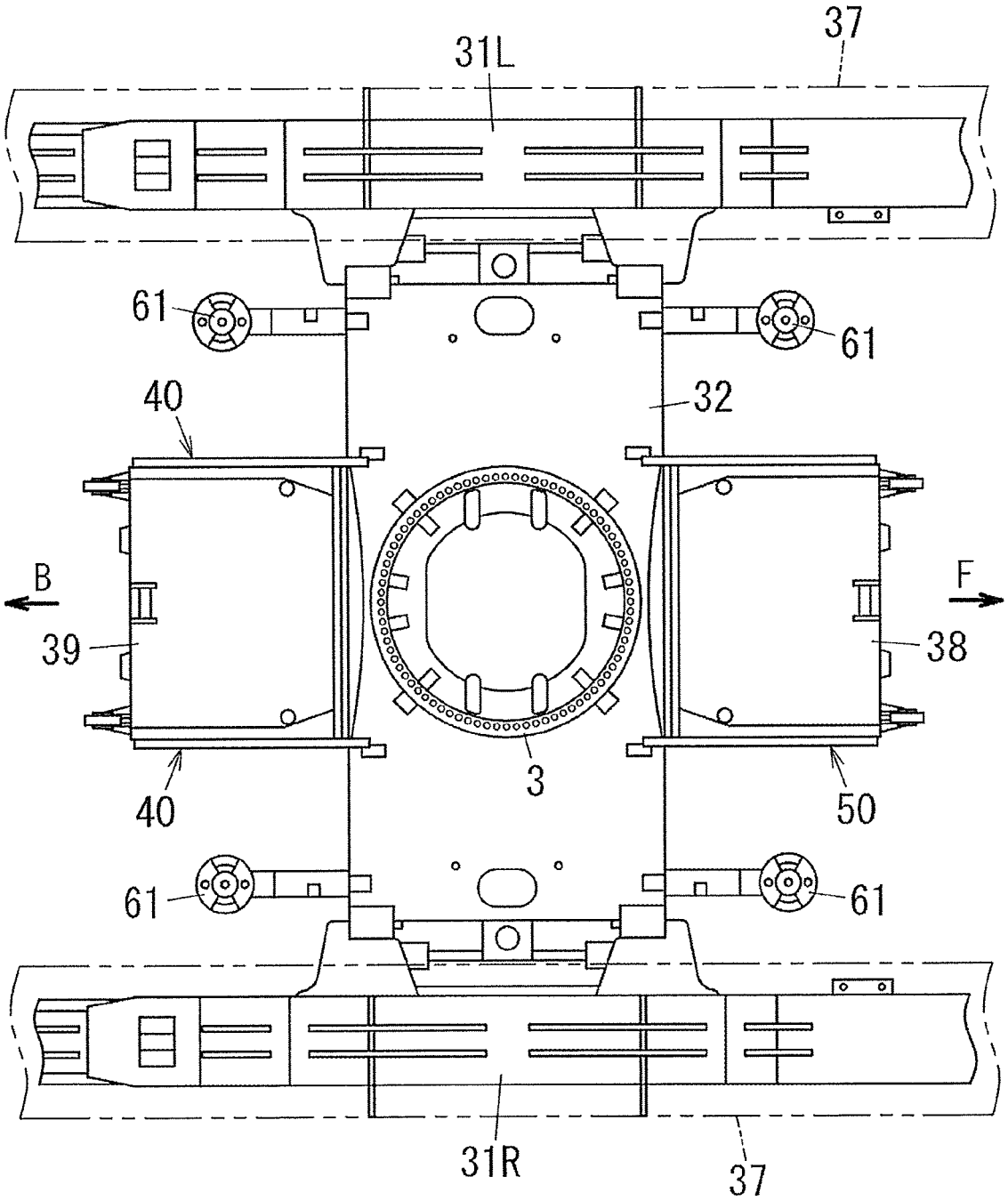
FIG. 4 is a fragmentary view as seen in the direction of the arrow X in FIG. 3.

On the other hand, the lower travelling body 2 includes, as shown in FIGS. 3 and 4, a pair of left and right crawler frames 31L, 31R extending in a front and rear direction, and a car body 32 connecting the crawler frames 31L, 31R and supporting the upper slewing body 4 via the slewing bearing 3. A travelling motor 33 is disposed on one end and an idler 34 is disposed on the other end of each of the crawler frames 31L, 31R in the front and rear direction, and upper rollers 35 are disposed on an upper surface and lower rollers 36 are disposed on a lower surface of each of the crawler frames 31L, 31R. A crawler 37 is mounted on an outer periphery of each of the crawler frames 31L, 31R via the travelling motor 33, the idler 34, the upper rollers 35 and the lower rollers 36. It should be noted that the front side of the lower travelling body 2 is not uniquely determined, but in the description hereinafter, the front side F will refer to the side where the idler 34 is, and the rear side B will refer to the side where the travelling motor 33 is, for descriptive purposes.

Figure 5A:
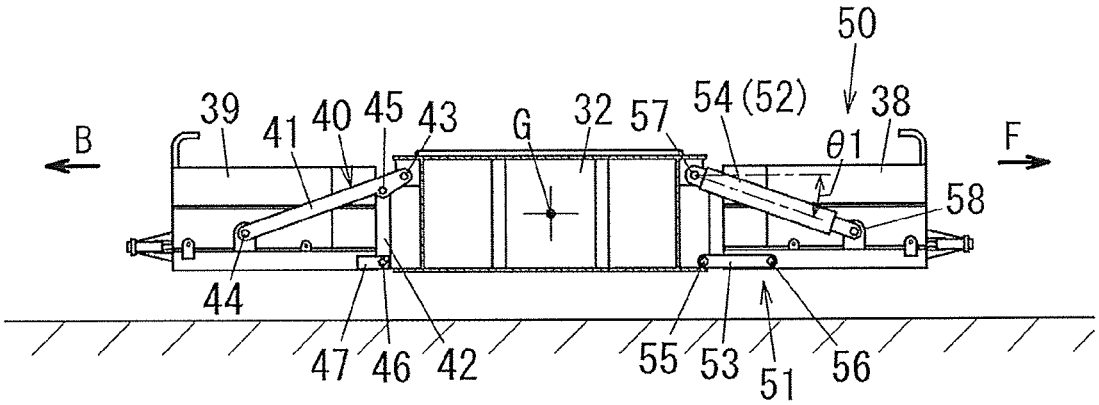
FIG. 5A is a side view showing a car body weight supporting device mounted on the crawler crane, the car body weight supporting a front car body weight at a normal position.
Figure 5B:
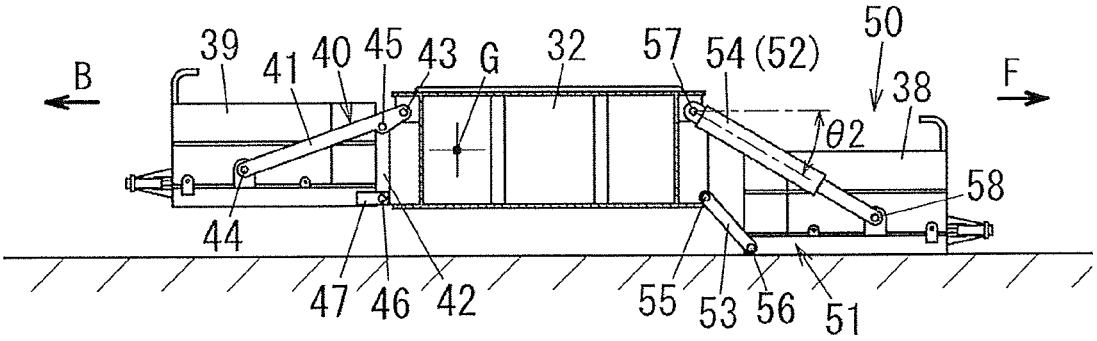
FIG. 5B is a side view showing the car body weight supporting device supporting the front car body weight at a ground position.

Further, as shown in FIGS. 5A and 5B, the lower travelling body 2 includes a pair of front and rear car body weights 38, 39 disposed on front and rear sides of the car body 32 and on both sides of a center of the slewing bearing 3 of the car body 32 (i.e. a pivotal center of the upper slewing body 4). The paired car body weights 38, 39 have substantially the same weight and shape, but have different attachment structures to the car body 32.

Specifically, in the paired car body weights 38, 39, the rear car body weight 39 is securely attached to the car body 32 via attachment members 40 provided on left and right sides thereof. Each attachment member 40 includes a first link 41 having a relatively long length, and a second link 42 having a shorter length than the first link 41. One end of the first link 41 is connected to an upper portion of the car body 32 via a pin 43, while the other end of the first link 41 is connected to a lower portion of the car body weight 39 via a pin 44. One end of the second link 42 is connected to an intermediate portion of the first link 41 via a pin 45, while the other end of the second link 42 is connected to the lower portion of the car body weight 39 via a pin 46 and a plate 47.

On the other hand, the front car body weight 38 is supported by a car body weight supporting device 50 movably with respect to the car body 32. The car body weight supporting device 50 includes a supporting mechanism 51 for movably supporting the car body weight 38, specifically, for movably supporting the car body weight 38 in a vertical direction between a normal position at which the car body weight 38 lies close to the front of the car body 32 and above the ground and a ground position at which the car body weight 38 comes into contact with the ground, and a drive section 52 for moving the car body weight 38 supported by the supporting mechanism 51 to thereby shift a center of gravity G of the lower travelling body 2 in the front and rear direction.

The supporting mechanism 51 includes pairs of a link member 53 and a hydraulic cylinder 54 respectively disposed on left and right sides of the car body weight 38. One end of each link member 53 is connected to a lower portion of the car body 32 via a pin 55, while the other end of each link member 53 is connected to a position in a lower portion of the car body weight 38 that is close to the car body via a pin 56. The link member 53 constitutes an auxiliary member. The pin 56 is provided movably in the front and rear direction along the lower portion of the car body weight 38 that is close to the car body. A head of the hydraulic cylinder 54 is connected to an upper portion of the car body 32 via a pin 57, while a rod of the hydraulic cylinder 54 is connected, via a pin 58, to a position in the lower portion of the car body weight 38 that lies more distant from the ear body 32 than a central position of the car body weight 38 in the front and rear direction, i.e. lies in the front portion of the car body weight 38. When the hydraulic cylinder 54 is contracted, as shown in FIG. 5A, the hydraulic cylinder 54 slopes down forward at a relatively small angle θ1 with respect to a horizontal line and the link member 53 extends substantially horizontally, to support the car body weight 38 at the normal position. When the hydraulic cylinder 54 is extended from the contracted state, as shown in FIG. 5B, the hydraulic cylinder 54 changes to slope down forward at a relatively great angle θ2 (greater than θ1) with respect to the horizontal line to move the car body weight 38 from the normal position to the ground position (position shown in FIG. 5B). Thus, the hydraulic cylinder 54 includes both the function of serving as a constituent member of the supporting mechanism 51 and the function of serving as the drive section 52. In other words, the supporting mechanism 51 and the drive section 52 include the common hydraulic cylinder 54.

The hydraulic cylinder 54 is not maximally extended when the car body weight 38 is at the ground position, and is operable to push the car body weight 38 against the ground at a specified pressure. The operation of the hydraulic cylinder 54 and, in turn, the operation of the car body weight supporting device 50 can be controlled by an operator by means of a control switch provided in the cab 5, though not shown in the present embodiment.

In FIG. 4, reference numerals 61 denote a total of four lifting devices that are disposed on respective both sides of the car body weights 38, 39 on the front and rear sides of the car body 32, the lifting devices being provided to raise and support the car body 32 in assembly of the crawler crane 1 or disassembly of the crawler crane 1 for conveyance.

Now, the operation of the car body weight supporting device 50 will be described. When the crawler crane 1 is in a working state, the front car body weight 38 supported by the supporting mechanism 51 of the car body weight supporting device 50 is, as shown in FIG. 5A, at the normal position at which the car body weight 38 lies close to the front of the car body 32 and above the ground. At this time, the center of gravity G of the lower travelling body 2 substantially coincides with the pivotal center axis of the upper slewing body 4 when seen from the side of the crawler crane 1. Therefore, the crawler crane 1 can stably perform a work, similarly to the conventional crawler crane in which the front car body weight 38 is securely attached to the car body 32 in the same manner as the rear car body weight 39.

On the other hand, as shown in FIG. 2, when the boom 6 is raised by a driving force of the crawler crane 1 in assembly of the crawler crane 1, for example, the upper slewing body 4 is oriented in advance such that the cab 5 disposed on the front portion thereof lies on the idler 34-side of the lower slewing body 2. When, in this state, the hydraulic cylinder 54 constituting the drive section 52 of the car body weight supporting device 50 is extended, the front car body weight 38 moves from the normal position to the ground position to come into contact with the ground. At this time, the weight of the front car body weight 38 is excluded from the weight of the lower travelling body 2, so that the center of gravity G of the lower travelling body 2 is shifted rearward from the pivotal center axis of the upper slewing body 4. Therefore, it is possible to prevent forward overturning and improve the postural stability of the crawler crane 1.

In particular, in the present embodiment, the hydraulic cylinder 54 is operable to push the front car body weight 38 against the ground at a specified pressure when the car body weight 38 is at the ground position. Therefore, it is possible to reduce the ground contact pressure that acts strongly on idler 34-side portions of the crawler frames 31L, 31R of the lower travelling body 2 according to the degree of pushing. Consequently, the safety can be further improved.

Figure 6A:
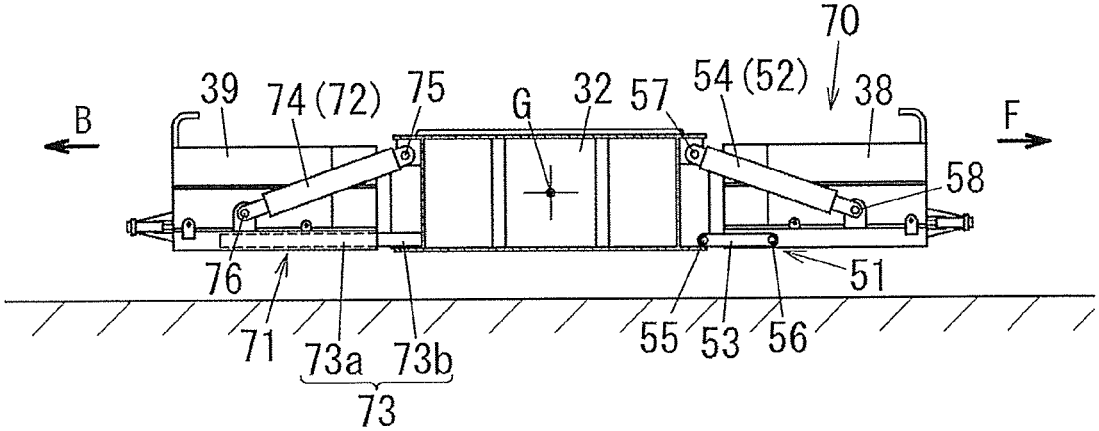
FIGS. 6A and 6B show views according to a second embodiment, FIG. 6A corresponding to FIG. 5A and FIG. 6B corresponding to FIG. 5B.
Figure 6B:
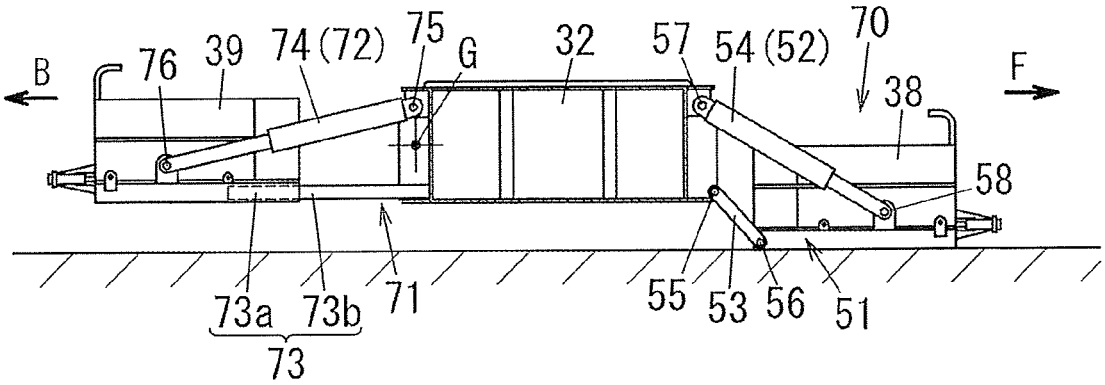

FIGS. 6A and 6B show a car body weight supporting device 70 for a crawler crane according to a second embodiment of the present invention. The car body weight supporting device 70 movably supports not only the front car body weight 38 but also the rear car body weight 39. A configuration of a portion of the car body weight supporting device 70 that movably supports the front car body weight 38 has the same configuration as the car body weight supporting device 50 in the first embodiment, and therefore, elements identical to those of the first embodiment will be denoted by the same respective reference numerals and descriptions thereof will be omitted. Hereinafter, a configuration of a portion of the car body weight supporting device 70 that movably supports the rear car body weight 39 will be described.

The car body weight supporting device 70 includes a supporting mechanism 71 for movably supporting the rear car body weight 39, specifically, for movably supporting the car body weight 39 in the front and rear direction between a close position at which the car body weight 39 lies close to the rear of the car body 32 and a distant position at which the car body weight 39 lies at a greater distance from the car body 32 than at the close position, and a drive section 72 for moving the car body weight 39 supported by the supporting mechanism 71 to thereby shift the center of gravity G of the lower travelling body 2 in the front and rear direction. It should be noted that both the close position and the distant position are each also regarded as a normal position at which the car body weight 39 lies above the ground.

The supporting mechanism 71 includes pairs of an telescopic member 73 and a hydraulic cylinder 74 respectively disposed on left and right sides of the car body weight 39. The telescopic member 73 includes a first member 73*a* in the form of a hollow body, and a second member 73*b* slidably placed in the first member 73*a*, the length of the telescopic member 73 varying according to the insertion amount of the second member 73*b* in the first member 73*a*. The first member 73*a* is secured horizontally to a lower portion of the car body weight 39. One end of the second member 73*b* that extends beyond the first member 73*a* is secured to a lower portion of the car body 32. The telescopic member 73 constitutes an auxiliary member. One end (specifically, one end of the second member 73*b*) of the telescopic member 73 is connected to the car body 32, while the other end (the first member 73*a*) of the telescopic member 73 is connected to the car body weight 39. A head of the hydraulic cylinder 74 is connected to an upper portion of the car body 32 via a pin 75, while a rod of the hydraulic cylinder 74 is connected to the lower portion of the car body weight 39 or the first member 73*a* of the telescopic member 73 via a pin 76. Contraction of the hydraulic cylinder 74 causes the telescopic member 73 to contract, as shown in FIG. 6A, to support the car body weight 39 lying at the close position, in cooperation with the hydraulic cylinder 74. When the hydraulic cylinder 74 is extended from the contracted state, the car body weight 39 moves from the close position to the distant position (position shown in FIG. 6B) to be supported, at the distant position, by the telescopic member 73 and the hydraulic cylinder 74 both being in the extended state. Thus, the hydraulic cylinder 74 includes both the function of serving as a constituent member of the supporting mechanism 71 and the function of serving as the drive section 72. In other words, the supporting mechanism 71 and the drive section 72 include the common hydraulic cylinder 74.

The operation of the hydraulic cylinder 74, similarly to that of the hydraulic cylinder 54 in the first embodiment, can be controlled by an operator by means of a control switch provided in the cab 5 (see FIG. 1), though not shown in the present embodiment.

Now, the operation of the car body weight supporting device 70 will be described. When the crawler crane 1 (see FIG. 1) is in the working state, as shown in FIG. 6A, the front car body weight 38 supported by the supporting mechanism 51 of the car body weight supporting device 70 is at the normal position at which the car body weight 38 lies close to the front of the car body 32 and above the ground, and the rear car body weight 39 supported by the supporting mechanism 71 of the car body weight supporting device 70 is at the close position at which the rear car body weight 39 lies close to the rear of the car body 32. At this time, the center of gravity G of the lower travelling body 2 substantially coincides with the pivotal center axis of the upper slewing body 4 when seen from the side of the crawler crane 1. Therefore, the crawler crane 1 can stably perform a work, similarly to the conventional crawler crane in which the paired front and rear car body weights 38, 39 are both securely attached to the car body 32.

On the other hand, when the boom 6 (see FIG. 1) is raised by a driving force of the crawler crane 1 in assembly of the crawler crane 1, for example, the hydraulic cylinder 54 constituting the drive section 52 of the car body weight supporting device 70 is extended to move the front car body weight 38 from the normal position to the ground position so that the front car body weight 38 comes into contact with the ground. At this time, the weight of the front car body weight 38 is excluded from the weight of the lower travelling body 2, so that the center of gravity G of the lower travelling body 2 is shifted rearward from the pivotal center axis of the upper slewing body 4. Therefore, it is possible to prevent forward overturning and improve the postural stability of the crawler crane 1.

Further, the hydraulic cylinder 54 is operable to push the front car body weight 38 against the ground at a specified pressure when the car body weight 38 is at the ground position. Therefore, it is possible to reduce the ground contact pressure that acts strongly on the idler 34-side portions of the crawler frames 31L, 31R of the lower travelling body 2 according to the degree of pushing. Consequently, the postural stability can be further improved.

Further, when the hydraulic cylinder 74 constituting the drive section 72 of the car body weight supporting device 70 is extended, the rear car body weight 39 moves from the close position to the distant position rearwardly away from the car body 32. Consequently, the center of gravity G of the lower travelling body 2 is shifted further rearward. This makes it possible to more reliably prevent forward overturning and more reliably improve the postural stability of the crawler crane 1.

FIGS. 7 to 11 show schematic configurations of car body weight supporting devices for a crawler crane according to third to seventh embodiments of the present invention, respectively. Each of these embodiments illustrates a modification of the car body weight supporting device 50 according to the first embodiment.

Figure 7:
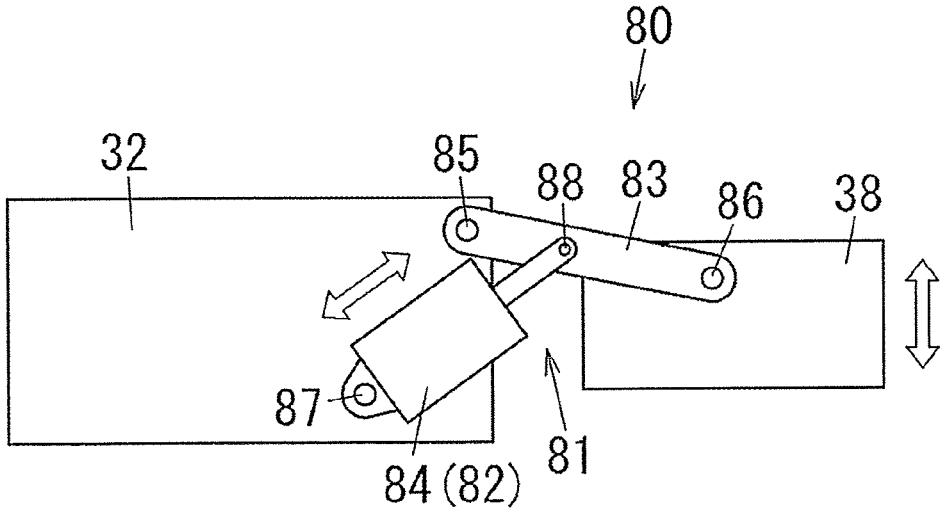
FIG. 7 is a side view showing a schematic configuration of a car body weight supporting device according to a third embodiment.

In the third embodiment shown in FIG. 7, a car body weight supporting device 80 includes a supporting mechanism 81 for movably supporting the car body weight 38 disposed on the front side of the car body 32 in the vertical direction between a normal position at which the car body weight 38 lies above the ground and a ground position at which the car body weight 38 comes into contact with the ground, and a drive section 82 for moving the car body weight 38 supported by the supporting mechanism 81 to thereby shift the center of gravity of the lower travelling body in the front and rear direction.

The supporting mechanism 81 includes pairs of a link member 83 and a hydraulic cylinder 84 respectively disposed on the left and right sides of the car body weight 38. One end of the link member 83 is connected to an upper portion of the car body 32 via a pin 85, while the other end of the link member 83 is connected to a central position of an upper portion of the car body weight 38 in the front and rear direction via a pin 86. The link member 83 constitutes an auxiliary member. A head of the hydraulic cylinder 84 is connected to a lower portion of the car body 32 via a pin 87, while a rod of the hydraulic cylinder 84 is connected to an intermediate portion of the link member 83 via a pin 88. When the hydraulic cylinder 84 is extended, as shown in FIG. 7, the link member 83 extends substantially horizontally with the intermediate portion thereof being supported by the hydraulic cylinder 84, and the car body weight 38 lying at the normal position is supported by the link member 83 and the hydraulic cylinder 84. When the hydraulic cylinder 84 is contracted from the extended state, the link member 83 pivots about the pin 85 to slope downward, thereby moving the car body weight 38 from the normal position to the ground position. Thus, the hydraulic cylinder 84 includes both the function of serving as a constituent member of the supporting mechanism 81 and the function of serving as the drive section 82. In other words, the supporting mechanism 81 and the drive section 82 include the common hydraulic cylinder 84.

Figure 8A:
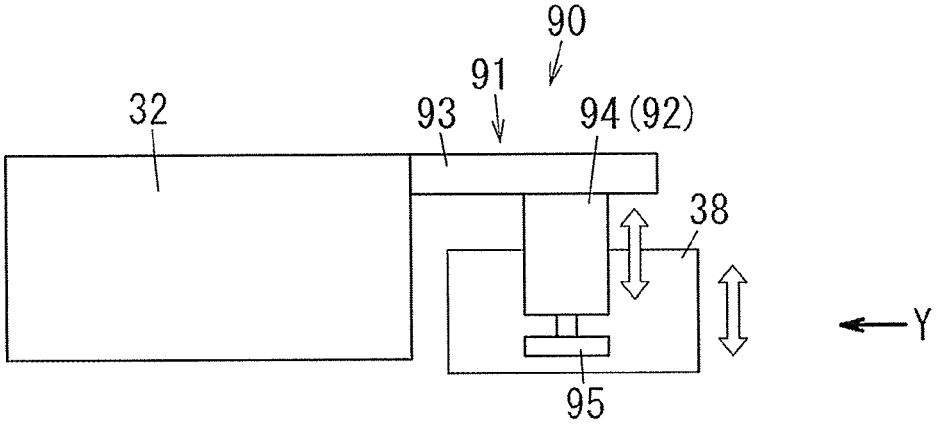
FIG. 8A is a view according to a fourth embodiment and corresponding to FIG. 7.
Figure 8B:
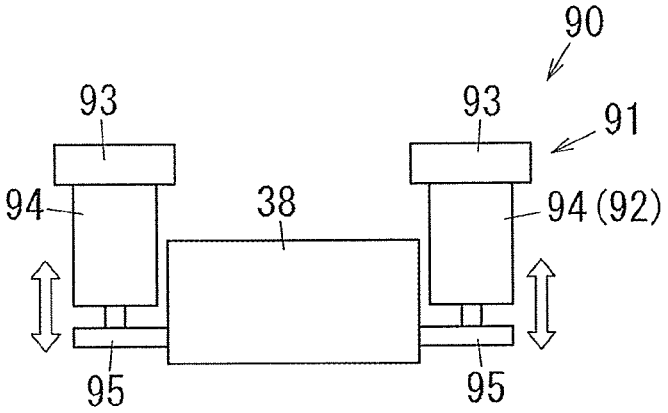
FIG. 8B is a fragmentary view as seen in the direction of the arrow Y in FIG. 8A.

In the fourth embodiment shown in FIGS. 8A and 8B, a car body weight supporting device 90 includes a supporting mechanism 91 for movably supporting the car body weight 38 disposed on the front side of the car body 32 in the vertical direction between a normal position at which the car body weight 38 lies above the ground and a ground position at which the car body weight 38 comes into contact with the ground, and a drive section 92 for moving the car body weight 38 supported by the supporting mechanism 91 to thereby shift the center of gravity of the lower travelling body in the front and rear direction.

The supporting mechanism 91 includes pairs of a supporting member 93 and a hydraulic cylinder 94 respectively disposed on the left and right sides of the car body weight 38. A proximal end of the supporting member 93 is secured to an upper portion of a front end surface of the car body 32. A head of the hydraulic cylinder 94 is secured to a lower surface of a distal end of the supporting member 93, while a rod of the hydraulic cylinder 94 is connected to a side surface of the car body weight 38 via a flange 95. When the hydraulic cylinder 94 is contracted, as shown in FIGS. 8A and 8B, the car body weight 38 lying at the normal position is supported by the supporting member 93 and the hydraulic cylinder 94. When the hydraulic cylinder 94 is extended from the contracted state, the car body weight 38 moves downward from the normal position to the ground position. Thus, the hydraulic cylinder 94 includes both the function of serving as a constituent member of the supporting mechanism 91 and the function of serving as the drive section 92. In other words, the supporting mechanism 91 and the drive section 92 include the common hydraulic cylinder 94.

Figure 9:
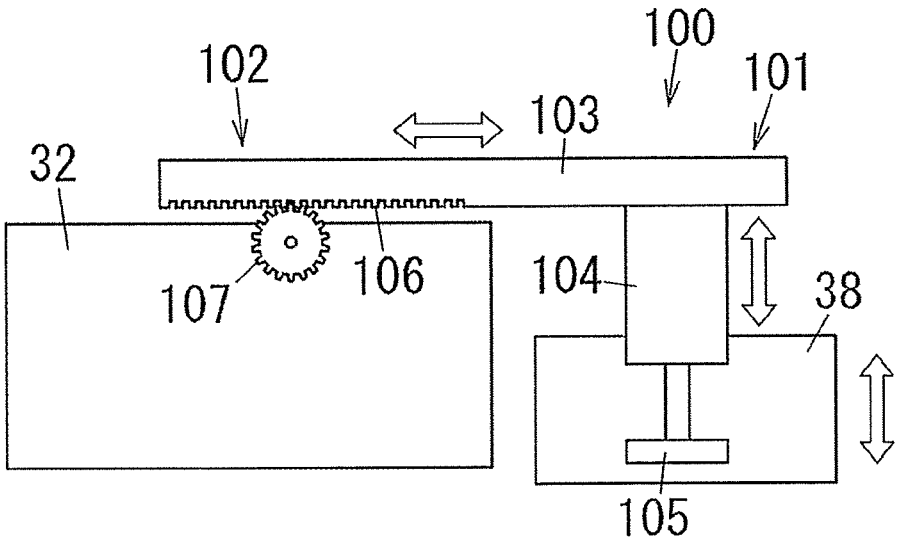
FIG. 9 is a view according to a fifth embodiment and corresponding to FIG. 7.

In the fifth embodiment shown in FIG. 9, a car body weight supporting device 100 includes a supporting mechanism 101 for movably supporting the car body weight 38 disposed on the front side of the car body 32 in the front and rear direction between a close position at which the car body weight 38 lies close to the car body 32 and a distant position at which the car body weight 38 lies at a greater forward distance from the car body 32 than at the close position and in the vertical direction between the close position or the distant position (i.e. a normal position at which the car body weight 38 lies above the ground) and a ground position, and a drive section 102 for moving the car body weight 38 supported by the supporting mechanism 101 to thereby shift the center of gravity of the lower travelling body in the front and rear direction.

The supporting mechanism 101 includes pairs of a supporting member 103 and a hydraulic cylinder 104 respectively disposed on the left and right sides of the car body weight 38. One end of the supporting member 103 is held on an upper surface of the car body 32 movably in the front and rear direction via a guide member (not shown), and the other end of the supporting member 103 projects forward of the car body 32. A head of the hydraulic cylinder 104 is secured to a lower surface of the other end of the supporting member 103, while a rod of the hydraulic cylinder 104 is connected to a side surface of the car body weight 38 via a flange 105.

A rack 106 is provided integrally or separately on a lower surface of the one end of the supporting member 103, the rack 106 extending in the front and rear direction. In correspondence to the rack 106, there are provided on a top surface of the car body weight 32 a pinion gear 107 meshable with the rack 106 and a hydraulic motor (not shown) for rotationally driving the pinion gear 107. The hydraulic motor rotates to move the supporting member 103 in the front and rear direction via the pinion gear 107 and the rack 106 to thereby move the car body weight 38 in the front and rear direction between the close position and the distant position. In addition, the hydraulic cylinder 104 extends and contracts to move the car body weight 38 in the vertical direction between the normal position and the ground position. Thus, the drive section 102 is constituted by the hydraulic motor, the rack 106, the pinion gear 107, and the hydraulic cylinder 104. The supporting mechanism 101 and the drive section 102 include the common hydraulic cylinder 104.

Figure 10:
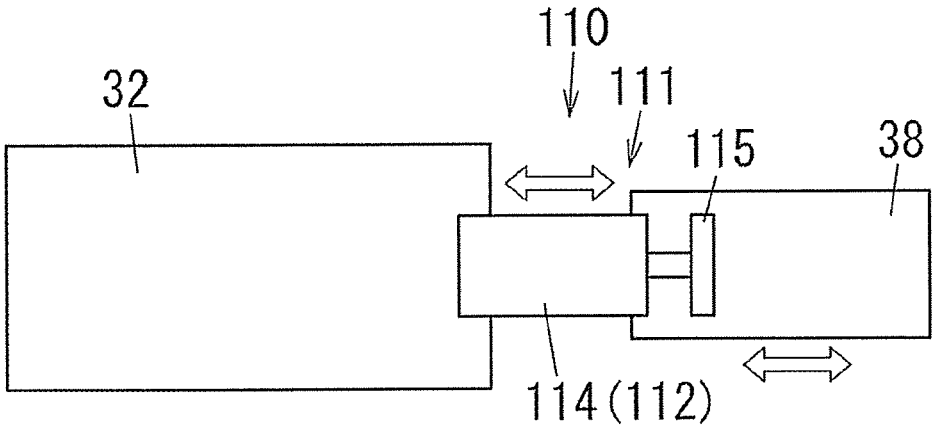
FIG. 10 is a view according to a sixth embodiment and corresponding to FIG. 7.

In the sixth embodiment shown in FIG. 10, a car body weight supporting device 110 includes a supporting mechanism 111 for movably supporting the car body weight 38 disposed on the front side of the car body 32 in the front and rear direction between a close position at which the car body weight 38 lies close to the car body 32 and a distant position at which the car body weight 38 lies at a greater forward distance from the ear body 32 than at the close position, and a drive section 112 for moving the car body weight 38 supported by the supporting mechanism 111 to thereby shift the center of gravity of the lower travelling body in the front and rear direction.

The supporting mechanism 111 includes hydraulic cylinders 114 respectively disposed on the left and right sides of the car body weight 38. A head of the hydraulic cylinder 114 is secured to the car body 32, while a rod of the hydraulic cylinder 114 is connected to a side surface of the car body weight 38 via a flange 115. The hydraulic cylinder 114 extends and contracts to move the car body weight 38 in the front and rear direction between the close position and the distant position. Thus, the hydraulic cylinder 114 includes both the function of serving as the supporting mechanism 111 and the function of serving as the drive section 112. In other words, the supporting mechanism 111 and the drive section 112 include the common hydraulic cylinder 114.

Figure 11:
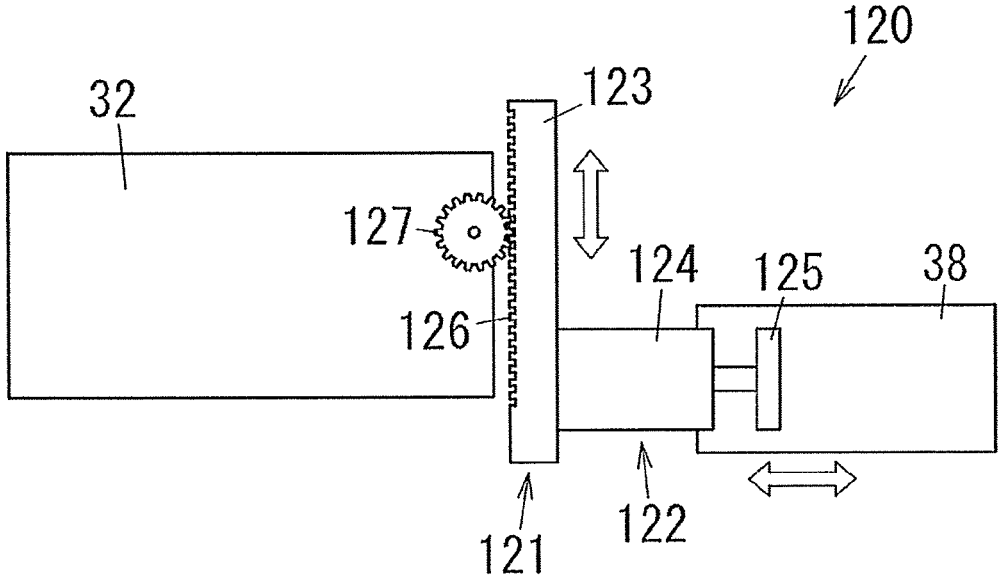
FIG. 11 is a view according to a seventh embodiment and corresponding to FIG. 7.

In the seventh embodiment shown in FIG. 11, a car body weight supporting device 120 includes a supporting mechanism 121 for movably supporting the car body weight 38 disposed on the front side of the car body 32 in the front and rear direction between a close position at which the car body weight 38 lies close to the car body 32 and a distant position at which the car body weight 38 lies at a greater forward distance from the car body 32 than at the close position and in the vertical direction between the close position or the distant position (i.e. a normal position at which the car body weight 38 lies above the ground) and a ground position, and a drive section 122 for moving the car body weight 38 supported by the supporting mechanism 121 to thereby shift the center of gravity of the lower travelling body in the front and rear direction.

The supporting mechanism 121 includes pairs of a supporting member 123 and a hydraulic cylinder 124 respectively disposed on the left and right sides of the car body weight 38. The supporting member 123 extends in the vertical direction along a front surface of the car body 32, and is held movably in the vertical direction via a guide member (not shown). A head of the hydraulic cylinder 124 is secured to a front surface of the supporting member 123, while a rod of the hydraulic cylinder 124 is connected to a side surface of the car body weight 38 via a flange 125.

A rack 126 is provided integrally or separately on a rear surface of the supporting member 123, the rack 126 extending in the front and rear direction that coincides with a longitudinal direction of the supporting member 123. In correspondence to the rack 126, there are provided on the car body weight 32 a pinion gear 127 meshable with the rack 126 and a hydraulic motor (not shown) for rotationally driving the pinion gear 127. The hydraulic motor rotates to move the supporting member 123 in the vertical direction via the pinion gear 127 and the rack 126 to thereby move the car body weight 38 in the vertical direction between the normal position and the ground position. In addition, the hydraulic cylinder 124 extends and contracts to move the car body weight 38 in the front and rear direction between the close position and the distant position. Thus, the drive section 122 is constituted by the hydraulic motor, the rack 126, the pinion gear 127, and the hydraulic cylinder 124. Further, the supporting mechanism 121 and the drive section 122 include the common hydraulic cylinder 124.

The present invention is not limited to the above-described first to seventh embodiments, and includes other various embodiments. For example, in the first embodiment, in the paired car body weights 38, 39 respectively disposed on the front and rear sides of the car body 32, the front car body weight 38 is supported movably in the vertical direction between the normal position and the ground position and the rear car body weight 39 is securely attached to the car body 32, and in the second embodiment, the front car body weight 38 is supported movably in the vertical direction between the normal position and the ground position and the rear car body weight 39 is supported movably in the front and rear direction between the close position and the distant position lying behind the close position. However, the present invention is not limited to these configurations, and it may be configured such that both of the paired car body weights 38, 39 are supported movably in the vertical direction between the normal position and the ground position or in the front and rear direction between the close position and the distant position, or it may be configured such that only the rear car body weight 39 is supported movably in the vertical direction between the normal position and the ground position.

In each of the first and second embodiments, the operation of the car body weight supporting device 50, 70 can be controlled by an operator by means of the control switch provided in the cab 5. However, the present invention may alternatively be configured to further include a detector for detecting the state of assembly of the crawler crane, and a controller for controlling the drive section 52, 72 of the car body weight supporting device 50, 70 based on a signal of the detector, to allow automatic control of the operation of the car body weight supporting device 50, 70.

Further, the car body weight 38, 39 is moved to shift the center of gravity of the lower travelling body 2 in the front and rear direction, but such usage has not been expected for an ordinary overload prevention device mounted in the crawler crane. Therefore, it is preferred to change the setting of the overload prevention device according to the shift amount of the center of gravity of the car body weight 38, 39 to improve the postural stability. Setting values are calculated and stored in advance, and from among which an appropriate value is set according to the movement. Alternatively, a value corresponding to a movement position selected by an operator may be set. For example, it is configured such that in disassembly or assembly of the crawler crane, an operator selects, from a display screen of the overload prevention device, a mode to raise an attachment or lower the attachment to the ground to move the car body weight accordingly so that an ML setting value (rated load) changes. Further, when a lifting of a heavy load performed within a great working radius is suspended by the overload prevention device, the car body weight is moved to slightly improve the postural stability so that the work can be performed without being suspended by the overload prevention device. The present invention can be applied in this manner.

As clear from the first to seventh embodiments described above, a crawler crane (1) according to a first aspect of the present invention includes: a lower travelling body (2); an upper slewing body (4) slewably mounted on the lower travelling body (2); an attachment (6) having a proximal end supported on a front portion of the upper stewing body (4) in a raisable and lowerable manner; and a counter weight (8) disposed on a rear portion of the upper slewing body (4). The lower travelling body (2) has a pair of left and right crawler frames (31L, 31R) each carrying a crawler (37), a car body (32) connecting the crawler frames (31L, 31R) and supporting the upper slewing body (4), and a pair of car body weights (38, 39) disposed on front and rear sides of the car body (32). A car body weight supporting device (50, 70, 80, 90, 100, 110, 120) for a crawler crane (1) according to the first aspect of the present invention includes: a supporting mechanism (51, 71, 81, 91, 101, 111, 121) for movably supporting at least one of the paired car body weights (38, 39); and a drive section (52, 72, 82, 92, 102, 112, 122) for moving the car body weight (38, 39) supported by the supporting mechanism (51, 71, 81, 91, 101, 111, 121) to thereby shift a center of gravity of the lower travelling body (2) in a front and rear direction.

According to the first aspect, it is possible to shift the center of gravity of the lower travelling body (2) in the front and rear direction by moving the car body weight (38, 39) supported by the supporting mechanism (51, 71, 81, 91, 101, 111, 121) by the drive section (52, 72, 82, 92, 102, 112, 122) according to the state of assembly or the like of the crawler crane (1). Therefore, it is possible to improve the postural stability.

In a car body weight supporting device (50, 70, 80, 90, 100, 120) for a crawler crane (1) according to a second aspect of the present invention, the supporting mechanism (51, 71, 81, 91, 101, 121) is configured in the first aspect to support the car body weight (38) movably in a vertical direction between a normal position at which the car body weight (38) lies above the ground and a ground position at which the car body weight (38) comes into contact with the ground.

According to the second aspect, when the car body weight (38) is moved from the normal position to the ground position, the center of gravity of the lower travelling body (2) shifts in a direction closer to the car body weight (39) opposite from the car body weight (38) lying at the ground position.

In a car body weight supporting device (50, 70, 80, 90, 100, 120) for a crawler crane (1) according to a third aspect of the present invention, the drive section (52, 72, 82, 92, 102, 122) is configured in the second aspect to be operable to push the car body weight (38) against the ground at a specified pressure when the car body weight (38) is at the ground position.

According to the third aspect, the drive section (52, 72, 82, 92, 102, 122) pushes the car body weight (38) against the ground at a specified pressure to make it possible to reduce the ground contact pressure that acts on the crawler frames (31L) (31R) of the lower travelling body (2) according to the degree of pushing. Consequently, the postural stability can be improved.

In a car body weight supporting device (70, 100, 110, 120) for a crawler crane (1) according to a fourth aspect of the present invention, the supporting mechanism (71, 101, 111, 121) is configured in the first, second or third aspect to support the car body weight (38, 39) movably in the front and rear direction between a close position at which the car body weight (38, 39) lies close to the car body (32) and a distant position at which the car body weight (38, 39) lies at a greater distance from the car body (32) than at the close position.

According to the fourth aspect, when the car body weight (38, 39) is moved from the close position to the distant position, the center of gravity of the lower travelling body (2) shifts in the direction of the movement of the car body weight (38, 39).

In a car body weight supporting device (50, 70, 80, 90, 100, 110, 120) for a crawler crane (1) according to a fifth aspect of the present invention, the supporting mechanism (51, 71, 81, 91, 101, 111, 121) and the drive section (52, 72, 82, 92, 102, 112, 122) and the drive section (52, 72, 82, 92, 102, 112, 122) are configured in the first, second, third, or fourth aspect to include common hydraulic cylinders (54, 74, 84, 94, 104, 114, 124) respectively disposed at least on left and right sides of the car body (32), one end of the hydraulic cylinder (54, 74, 84, 94, 104, 114, 124) being connected to the car body (32) and the other end of the hydraulic cylinder (54, 74, 84, 94, 104, 114, 124) being connected to the car body weight (38, 39) to move the car body weight (38, 39) by extension or contraction of the hydraulic cylinder (54, 74, 84, 94, 104, 114, 124).

In a car body weight supporting device (50, 70, 80) for a crawler crane (1) according to a sixth aspect of the present invention, the supporting mechanism (51, 71, 81) is configured in the fifth aspect to include auxiliary members (53, 73, 83) respectively disposed on the left and right side of the car body (32), one end of the auxiliary member (53, 73, 83) being connected to the car body (32), and the other end of the auxiliary member (53, 73, 83) being connected to the car body weight (38, 39).

The invention claimed is:

1. A car body weight supporting device for a crawler crane including: a lower travelling body; an upper slewing body slewably mounted on the lower travelling body; an attachment having a proximal end supported on a front portion of the upper slewing body in a raisable and lowerable manner; and a counter weight disposed on a rear portion of the upper slewing body, the lower travelling body having a pair of left and right crawler frames each carrying a crawler, a car body connecting the crawler frames and supporting the upper slewing body, and a pair of car body weights disposed on front and rear sides of the car body, the car body weight supporting device comprising:

a supporting mechanism for movably supporting at least one of the paired car body weights; and a drive section for moving the car body weight supported by the supporting mechanism to thereby shift a center of gravity of the lower travelling body in a front and rear direction.

2. The car body weight supporting device for a crawler crane according to claim 1, wherein the supporting mechanism supports the car body weight movably in a vertical direction between a normal position at which the car body weight lies above the ground and a ground position at which the car body weight comes into contact with the ground.

3. The car body weight supporting device for a crawler crane according to claim 2, wherein the drive section is operable to push the car body weight against the around at a specified pressure when the car body weight is at the ground position.

4. The car body weight supporting device for a crawler crane according to claim 1, wherein the supporting mechanism supports the car body weight movably in the front and rear direction between a close position at which the car body weight lies close to the car body and a distant position at which the car body weight lies at a greater distance from the car body than at the close position.

5. The car body weight supporting device for a crawler crane according claim 2, wherein the supporting mechanism supports the car body weight movably in the front and rear direction between a close position at which the car body weight lies close to the car body and a distant position at which the car body weight lies at a greater distance from the car body than at the close position.

6. The car body weight supporting device for a crawler crane according claim 3, wherein the supporting mechanism supports the car body weight movably in the front and rear direction between a close position at which the car body weight lies close to the car body and a distant position at which the car body weight lies at a greater distance from the car body than at the close position.

* * * * *